US006282996B1

(12) United States Patent
Berg et al.

(10) Patent No.: US 6,282,996 B1
(45) Date of Patent: Sep. 4, 2001

(54) MULTIPURPOSE LOCKING PLIERS

(75) Inventors: Howard G. Berg, Gresham; Timothy S. Leatherman, Portland; Benjamin C. Rivera, West Linn, all of OR (US); Reinhard Srajer, Vancouver, WA (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 09/240,204

(22) Filed: Jan. 29, 1999

(51) Int. Cl.[7] ..... B25B 7/02
(52) U.S. Cl. ..... 81/427.5; 7/125; 7/128
(58) Field of Search ..... 7/128–134, 125; 30/167; 81/427.5

(56) References Cited

U.S. PATENT DOCUMENTS

| | | | | |
|---|---|---|---|---|
| 1,372,579 | | 3/1921 | Weishaupt . | |
| 2,197,136 | | 4/1940 | Share et al. | 30/160 |
| 2,201,918 | | 5/1940 | Petersen | 81/84 |
| 2,514,130 | * | 7/1950 | Jones | 81/427.5 |
| 3,568,315 | | 3/1971 | Smith | 30/161 |
| 3,585,704 | | 6/1971 | Schroeder | 29/275 |
| 4,040,181 | | 8/1977 | Johnson | 30/161 |
| 4,238,862 | | 12/1980 | Leatherman | 7/128 |
| 4,297,756 | | 11/1981 | Lance | 7/127 |
| 4,519,756 | | 5/1985 | Heldt | 81/427.5 |
| 4,648,145 | | 3/1987 | Miceli | 7/158 |
| 4,669,140 | | 6/1987 | Miceli | 7/158 |
| 4,888,869 | | 12/1989 | Leatherman | 30/161 |
| 4,995,128 | | 2/1991 | Montgomery et al. | 7/127 |
| 5,014,379 | | 5/1991 | Hull et al. | 7/127 |
| 5,029,355 | * | 7/1991 | Thai | 7/118 |
| 5,033,140 | | 7/1991 | Chen et al. | 7/127 |
| 5,062,173 | | 11/1991 | Collins et al. | 7/118 |
| 5,072,513 | | 12/1991 | Matasushima | 30/161 |
| 5,212,844 | * | 5/1993 | Sessions et al. | 7/128 |
| 5,251,353 | | 10/1993 | Lin | 7/128 |
| 5,267,366 | | 12/1993 | Frazer | 7/128 |
| 5,280,659 | | 1/1994 | Park | 7/128 |
| 5,327,651 | | 7/1994 | Favreau | 30/161 |
| 5,511,310 | | 4/1996 | Sessions et al. | 30/161 |
| 5,697,114 | | 12/1997 | McIntosh et al. | 7/129 |
| 5,743,552 | | 4/1998 | Rivera | 294/99.2 |
| 5,765,247 | | 6/1998 | Seber et al. | 7/128 |
| 5,781,950 | | 7/1998 | Swinden et al. | 7/128 |
| 5,791,002 | | 8/1998 | Gardiner et al. | 7/128 |
| 5,809,599 | | 9/1998 | Frazer | 7/128 |
| 5,809,600 | | 9/1998 | Cachot | 7/128 |
| 5,904,078 | * | 5/1999 | Gustafson et al. | 81/417 |

FOREIGN PATENT DOCUMENTS

| | | |
|---|---|---|
| 0 854 014 A1 | 7/1998 | (EP) . |
| 2 760 955 A1 | 9/1998 | (FR) . |

OTHER PUBLICATIONS

Kershaw Knives, MultiTool Model A100 At least as early as Jan. 1988.

SOG Specialty Knives, Inc., PowerLock® Multipurpose Tool At least as early as Nov. 27, 1998.

* cited by examiner

*Primary Examiner*—Joseph J. Hail, III
*Assistant Examiner*—Lee Wilson
(74) *Attorney, Agent, or Firm*—Chernoff, Vilhauer, McClung & Stenzel, LLP

(57) ABSTRACT

A folding multipurpose tool including adjustable locking pliers with an over-center locking mechanism to retain the jaws in a gripping condition. The jaws of the locking pliers can be folded into the handles of the tool to produce a compact folded configuration. A latch mechanism in the tool handle retains a selected one of several folding tool bits or blades in an extended position for use and includes an abutment arrangement to prevent such a selected tool bit from being extended too far. A spring associated with a tool bit driving socket retains separate tool bits and resists inadvertent removal of an adjustment screw element of the locking pliers. Upon removal of the adjustment screw element, special bits, such as a corkscrew, can be screwed into the tool bit driving socket.

32 Claims, 11 Drawing Sheets

19
40
68
42
156
155
32
30
58
38
54
96
98
52
126
124
154
160
158
78
88
76
71
66
104
100
72
70
84
53
64
44
204
48
46
200
73
198
196
176
34
60
194
36
62
102
122
134
128

MULTIPURPOSE LOCKING PLIERS

BACKGROUND OF THE INVENTION

The present invention relates to multipurpose hand tools, and in particular to such a tool which has over-center locking pliers and can be folded into a compact configuration.

Folding multipurpose hand tools have become well known in recent years. Representative tools of this sort are disclosed in, for example, Leatherman U.S. Pat. No. 4,238,862, Leatherman U.S. Pat. No. 4,888,869, Sessions et al. U.S. Pat. No. 5,212,844, Frazer U.S. Pat. No. 5,267,366, MacIntosh U.S. Pat. No. 5,697,114, Gardiner et al. U.S. Pat. No. 5,791,002 and Frazer U.S. Pat. No. 5,809,599. While many of such tools have included folding pliers, only Thai U.S. Pat. No. 5,029,355 discloses pliers capable of being locked by an over-center locking arrangement, and whose jaws can be folded to make such a tool more compact. The Kershaw Multi-Tool™, now on the market, has over-center locking pliers, but the jaws do not fold. Of course, the best known of locking pliers is the Peterson Vise-Grip®, but it is not foldable for compact storage, nor is it multipurpose.

Previously-known multipurpose tools with over-center locking pliers have been of operable design, but have lacked strength, or useful features, or have been unattractive in appearance, or have not been able to be folded into a suitably compact configuration; and thus such tools have been less than completely satisfactory for their intended purpose.

In multipurpose folding tools, various latch mechanisms have been utilized in the past, as represented, for example, by Seber et al. U.S. Pat. No. 5,765,247, and Swinden et al. U.S. Pat. No. 5,781,950, to retain folding tool bits and blades in desired positions, either folded and stowed within a cavity provided in a tool handle, or rigidly and safely extended ready for use. The previously available latching arrangements, however, have had various drawbacks, either from the standpoint of operability, strength, and reliability, or from the standpoint of manufacturing costs.

Socket wrenches and hex bit drivers are well known. Adaptors to connect hex bits or sockets or both to multipurpose tools are also well known. See, for example, Heldt U.S. Pat. No. 4,519,278, Chen U.S. Pat. No. 5,033,140, Lin U.S. Pat. No. 5,251,353, Park U.S. Pat. No. 5,280,659, and Cachot U.S. Pat. No. 5,809,600. Tool bit drive adaptors, however, are an additional item which must be carried and kept together with the multipurpose tool to enable it to be used to drive such tool bits. Also, currently available drivers do not work well with special bits, such as corkscrews, which must be pulled, rather than pushed, in use.

What is desired, then, is an improved folding multipurpose tool including pliers with over-center locking jaws capable of exerting significant gripping force and whose jaws can be folded. Also desired are a folding multipurpose tool including an improved mechanism for locking and unlocking various blades, and a folding multipurpose tool including an improved holder for hex bit tools. Preferably, such a tool should be of sturdy, reliable construction, be able to be manufactured at a reasonable cost, and have a pleasing appearance, and be capable of folding into a compact storage configuration so as to be easily carried and readily available for use when needed. Also preferable in such a tool is that most of the motions and positionings of the various components that are required when using the tool occur automatically or are intuitive to the user.

SUMMARY OF THE INVENTION

The present invention overcomes some of the aforementioned shortcomings of the prior art and answers some of the aforementioned needs by providing a folding multipurpose tool incorporating adjustable locking pliers jaws that can be extended into an operational configuration in which the tool may be adjusted to grip objects of different sizes and may be locked by an over-center mechanism while still providing gripping force against an object or objects located between the jaws.

In one preferred embodiment of such a tool a pair of jaws are mounted on a jaw pivot shaft on one end of a first handle, and a corresponding end of a second handle is removably connected to a lower one of the jaws to control its movement toward an upper one of the jaws.

In one preferred embodiment of the invention, a jaw-moving linkage includes a pair of struts extending between the handles, and the jaws extend between the struts when the tool is folded into a compact folded configuration.

As another separate aspect of the present invention, a folding tool including locking pliers has a jaw-moving linkage including a thrust body which interconnects a portion of the jaw-moving linkage to one jaw of the pliers through a pivot joint including mating concave and convex surfaces contacting each other, through which the jaw-moving linkage pushes against a heel portion of that jaw.

In one embodiment of that aspect of the invention a spring detent arrangement is provided to keep the pivot joint assembled as desired but permit it to be disconnected easily in order to fold the jaws into the handle to place the tool into its compact folded configuration.

Another separate aspect of the present invention is to provide a latch mechanism to retain one or more folding blades or tool bits in a selected position with respect to a handle of a multipurpose folding tool.

In a preferred embodiment of this aspect of the invention such a mechanism includes a latch release lever carried on a pivot in a channel-configured portion of one of the handles, and a spring formed as a portion of the handle keeps a catch body carried on the latch release lever engaged with at least one of the blades.

In one preferred embodiment of this aspect of the invention each of the blades includes a base portion defining a notch from which the catch body can be released to permit the blade to be moved between its folded and extended positions, while the catch body still prevents the blade from being moved beyond its intended extended position, and the handle and the latch release lever cooperate to prevent the catch body from moving beyond its intended blade-releasing position.

Yet another separate aspect of the present invention is that it provides a tool bit drive socket, with a threaded bore at an inner end of the socket, allowing the tool bit drive socket to receive not only conventional tool bits but also special bits threaded at one end.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Folding Jaws

Figure 1:
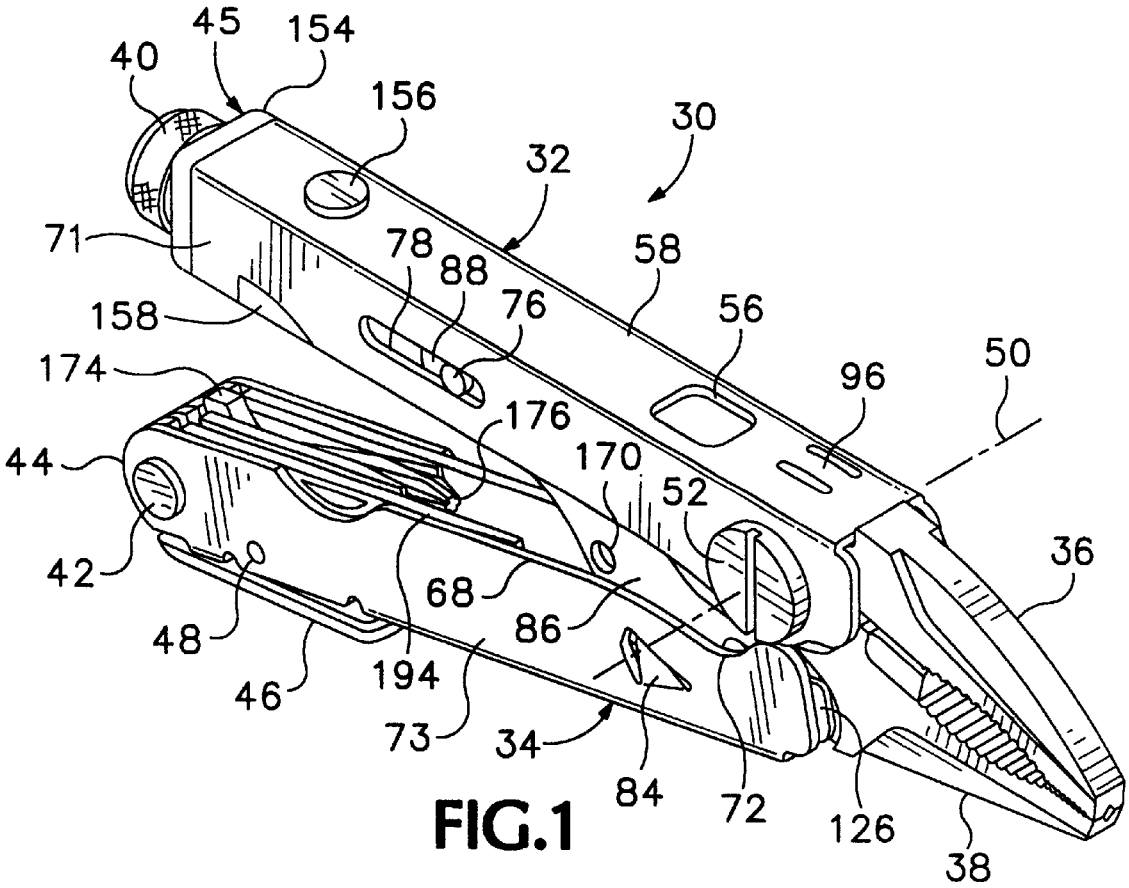
FIG. 1 is a perspective view of a folding multipurpose tool that is a preferred embodiment of the present invention, with the locking pliers jaws in an extended and operational configuration.

Referring now to drawings which form a part of the disclosure herein, in a preferred embodiment of the invention a folding multipurpose tool 30 shown in FIG. 1 has an upper handle 32, which may also be referred to as a first body member, and a lower handle 34, which may also be referred to as an operating lever. A pair of jaws such as an upper pliers jaw 36 and a lower pliers jaw 38 are attached to the handles 32 and 34. In a preferred embodiment of the multipurpose tool 30, the handles 32 and 34 have the general shape of channels facing toward each other, and may be of sheet metal such as fine-blanked stainless steel about 0.05 inch thick, for example, while the jaws 36 and 38 may be investment castings, suitably finished.

An over-center jaw-locking mechanism is included in the tool, and can be adjusted using an adjustment knob 40 located at the rear end 45 of the upper handle 32 to permit the jaws 36 and 38 to be locked while gripping objects of various sizes. Various folding tool blades are normally stored within the lower handle 34 and can be rotated about an axis defined by a-pivot shaft 42 extending transversely at the rear end 44 of the lower handle 34. The tool blades are kept either in a folded position or an extended position by a latch mechanism including a latch lever 46. The latch lever 46 may be metal injection molded and is carried on a latch lever pivot pin 48 extending transversely through bores in the sides of the lower handle 34.

The multipurpose folding tool 30 can be folded into a compact folded configuration, shown in FIGS. 2, 3, 4 and 5, after disengaging the lower handle 34 from the lower jaw 38. Both the upper jaw 36 and the lower jaw 38 are carried on the upper handle 32 and can be rotated with respect to it, from the positions shown in FIG. 1 to the positions shown in FIG. 2, about a main jaw pivot axis 50 defined by a jaw pivot shaft 52 extending transversely through the sides of the upper handle 32, near a front end 53 of the upper handle 32. While the jaw pivot shaft 52 may be a rivet, it may also be in the form of a solid or tubular bolt and nut engaged by mating threads. The large ends of the jaw pivot shaft help prevent side play and misalignment of the jaws.

It will be appreciated that a different arrangement might be used instead to allow the lower jaw 38 to pivot with respect to the upper jaw 36 about an axis not necessarily coincident with the pivot axis 50, if desired.

When the multipurpose tool 30 is in the folded configuration as shown in FIGS. 2–5, a heel portion 54 of the lower jaw 38 extends outward through an aperture 56 in the outer side, or back 58 of the upper handle 32. Similarly, a portion of the upper jaw 36 extends outward through an aperture 60 in the outer side, or back 62 of the lower handle 34.

When the folding multipurpose tool 30 is in the compact, folded configuration shown in FIGS. 2–5, the front end 53 of the upper handle is aligned with the front end 64 of the lower handle 34, and the upper and lower handles 32 and 34 lie alongside each other with an inner side or margin 66 of the upper handle 32 lying closely alongside and facing toward an inner side or margin 68 of the lower handle 34. An arcuate projecting portion 70 of each side 71 of the channel of the upper handle 32, adjacent the jaw pivot axis 50, fits closely within a corresponding hollow 72 in each opposite side 73 of the channel of the lower handle 34.

Figure 6:
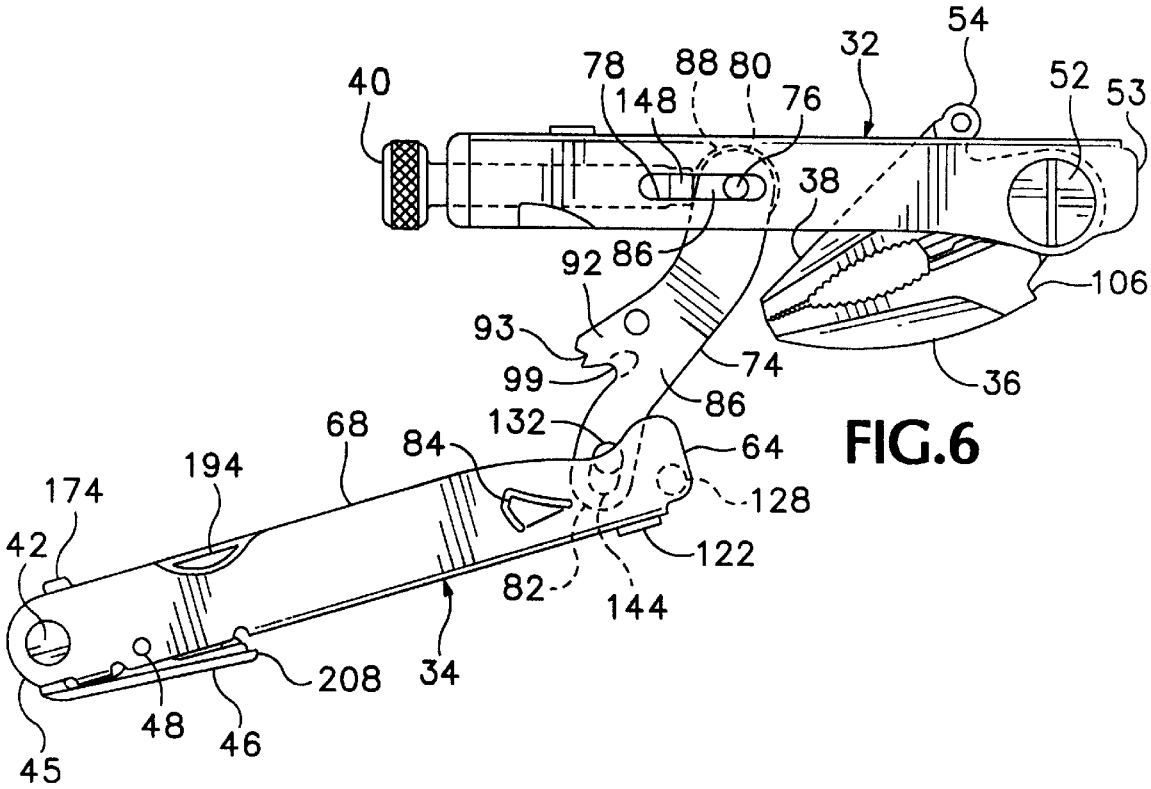
FIG. 6 is a right side elevational view of the folding tool shown in FIG. 1, with its handles separated as a first step in moving the jaws of the locking pliers to change the tool from the fully folded configuration into an extended and operational configuration.

The locking pliers jaws 36 and 38 are unfolded from the folded configuration shown in FIGS. 2–5 and placed into the operative configuration shown in FIG. 1 by the steps shown in FIGS. 6–9. First the lower handle 34 is moved downwardly and rearwardly away from the upper handle 32 as shown in FIG. 6. A strut assembly 74 interconnects the upper and lower handles 32 and 34, with a pin 76 engaged in a slot 78 in each side of the upper handle 32 connecting the rear end 80 of the strut assembly 74 with the upper handle 32. The front end 82 of the strut assembly 74' is interconnected with the front end 64 of the lower handle 34 as will be explained in greater detail below.

Figure 7:
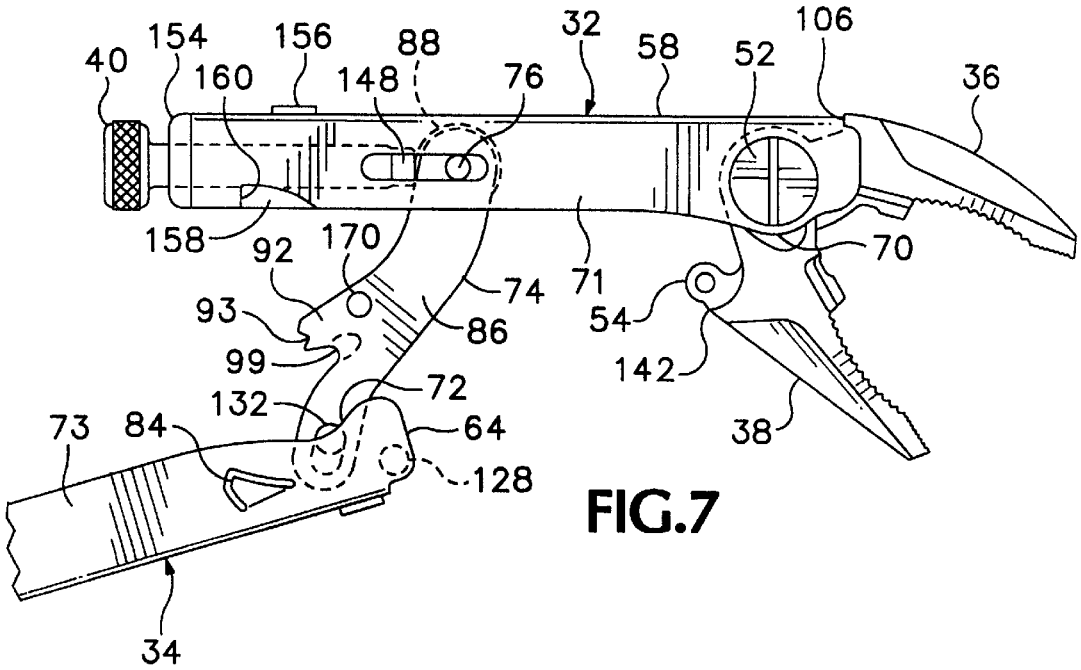
FIG. 7 is a view of the tool showing the next step of placing the locking pliers jaws into their operational configuration.

With the lower handle 34 in the position shown in FIG. 6 the jaws 36 and 38 can be rotated outward about the main jaw pivot axis 50 to the position shown in FIG. 7. As shown in FIG. 7 the upper jaw 36 in its extended position abuts against the back 58 of the upper handle 32 at its front end 53. The lower jaw 38 has also been rotated counterclockwise from its position shown in FIG. 6, so that the heel 54 of the lower jaw 38 is exposed below the sides 71 of the upper handle 32.

Figure 8:
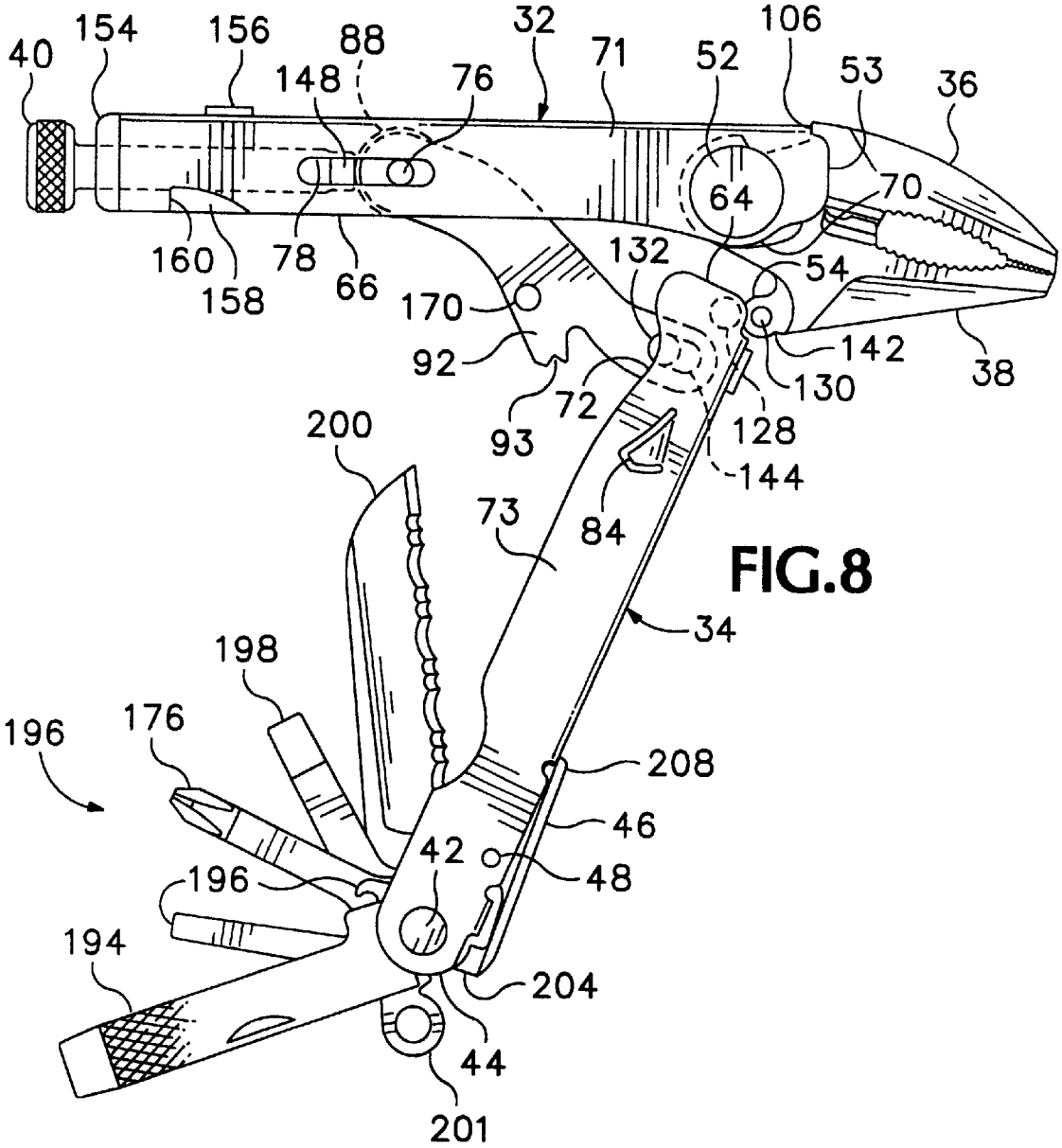
FIG. 8 is a side elevational view of the folding tool showing the next step in readying the locking pliers of the tool for use, and showing several folding tool blades carried in the second handle of the tool.
Figure 8A:
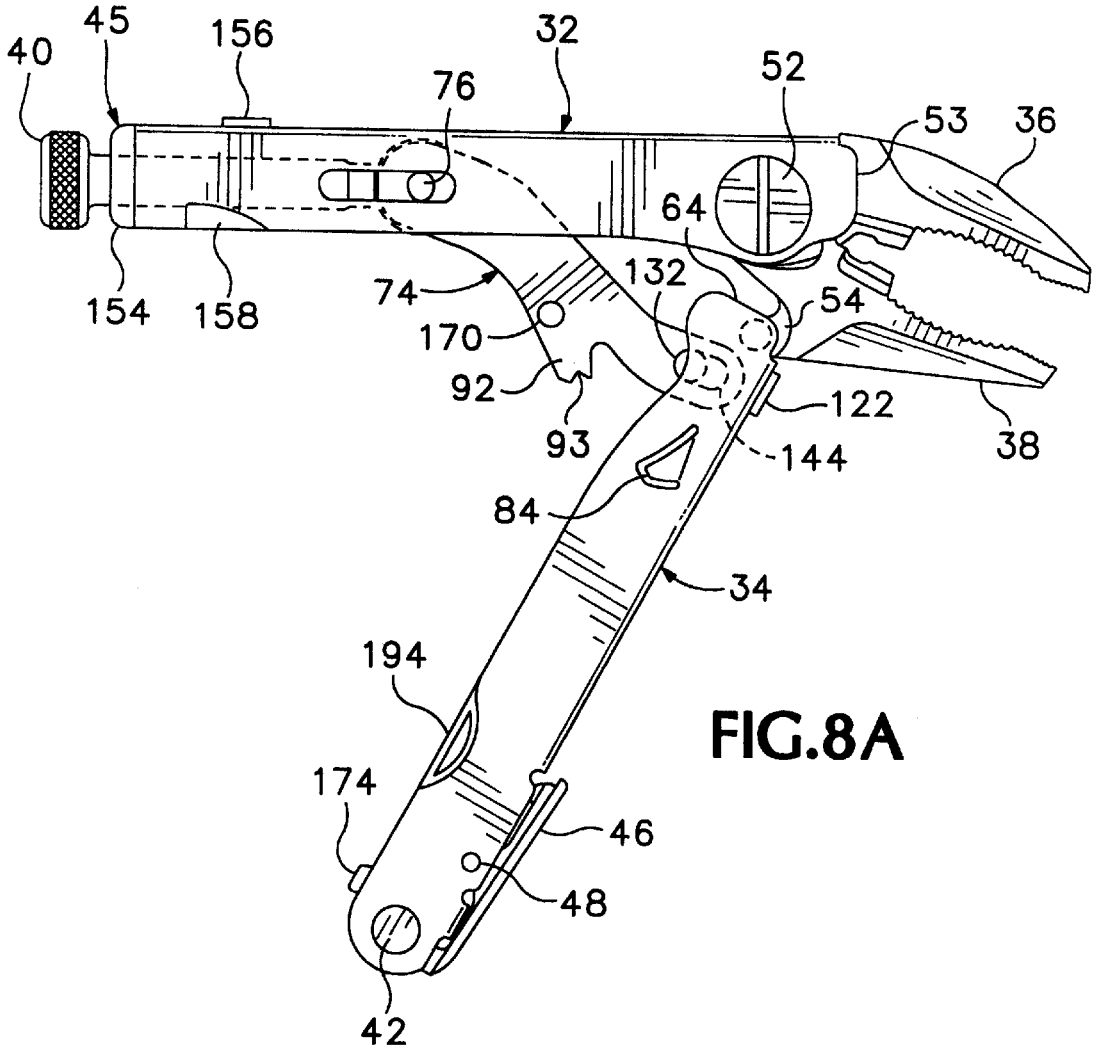
FIG. 8A is a side elevational view of the folding tool in an operational configuration with the jaws of the adjustable locking pliers open, ready for use.

The lower handle 34 is then brought forward, and its front end 64 is mated releasably with the heel 54 of the lower jaw 38 so that the front end 64 of the lower handle 34 can rotate about the heel 54 of the lower jaw 38. This can be done most easily with the adjustment knob 40 turned in to the position shown in FIG. 8, when the front end 64 can be mated with the heel 54 by rotating the lower handle 34 (in a clockwise direction as the tool is shown in FIG. 8) until mating occurs. Once the front end 64 is mated with the heel 54 of the lower jaw 38, as shown in FIG. 8A, rotation of the lower handle 34 in a clockwise direction about the heel 54 moves the jaws 36 and 38 toward each other, and toward the position of the jaws shown in FIG. 9.

Figure 10:
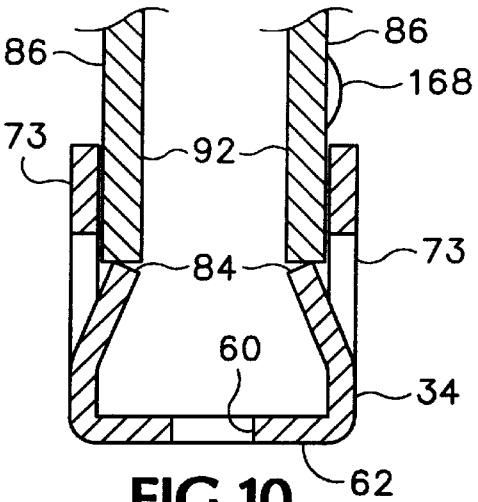
FIG. 10 is a section view taken along line 10—10 of FIG. 9.

Movement of the lower handle 34, or operating lever, toward the upper handle 32 is limited, maintaining a space between the upper and lower handles 32 and 34 so that they can be manipulated easily to move the jaws 36 and 38 apart from or toward each other as desired. This limitation of the movement of the lower handle 34 is accomplished by a pair of limit stops 84 in the lower handle 34. Preferably, the limit stops 84 have a form resembling wings, defined by a slit in each side of the lower handle 34 and are bent inward slightly to extend into the space between the sides 73 of the lower handle 34, as shown in FIG. 10.

Figure 11A:
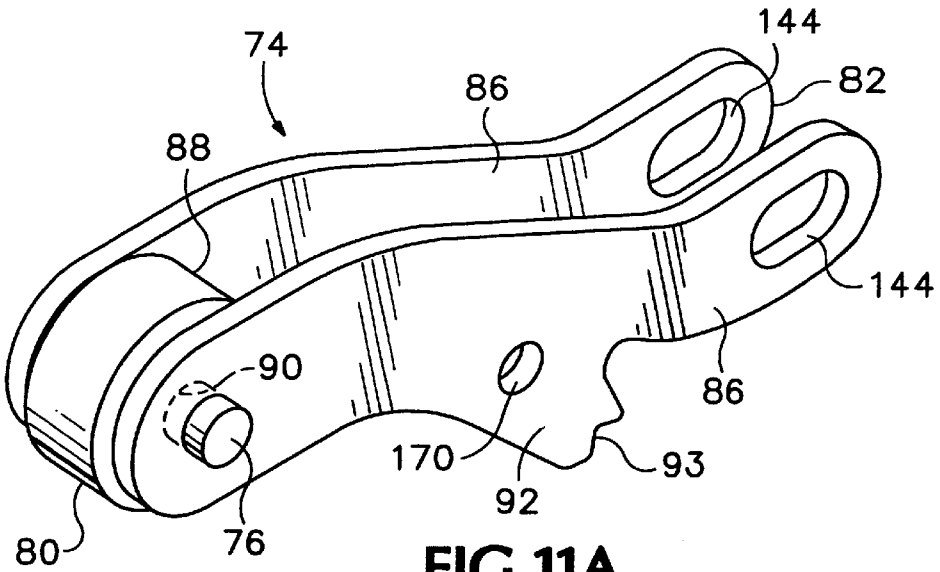
FIG. 11A is an isometric view showing the strut assembly from the upper right rear.
Figure 11:
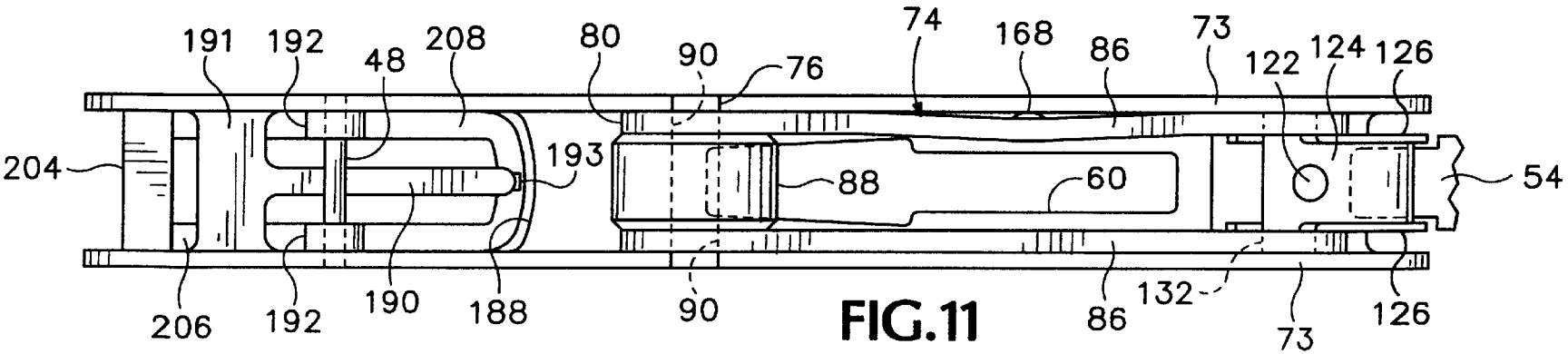
FIG. 11 is a top plan view taken in the direction of line 11—11 in FIG. 9, showing the strut assembly and the lower handle portion of the tool, but omitting the upper handle and the folding tool blades shown in FIG. 8, for the sake of clarity.

Referring also to FIGS. 11 and 11A, the strut assembly 74 includes a pair of struts 86, preferably of sheet steel, that are spaced apart from each other at the rear end 80 of the strut assembly 74, by a strut block 88 which is, in a preferred embodiment of the invention, generally cylindrical. The pin 76 extends centrally through the strut block 88 and corresponding bores 90 in the struts 86. Preferably, the pin 76 fits tightly and must be pressed into the bores 90 and thus keeps the struts 86 tightly alongside the strut block 88.

Figure 9:
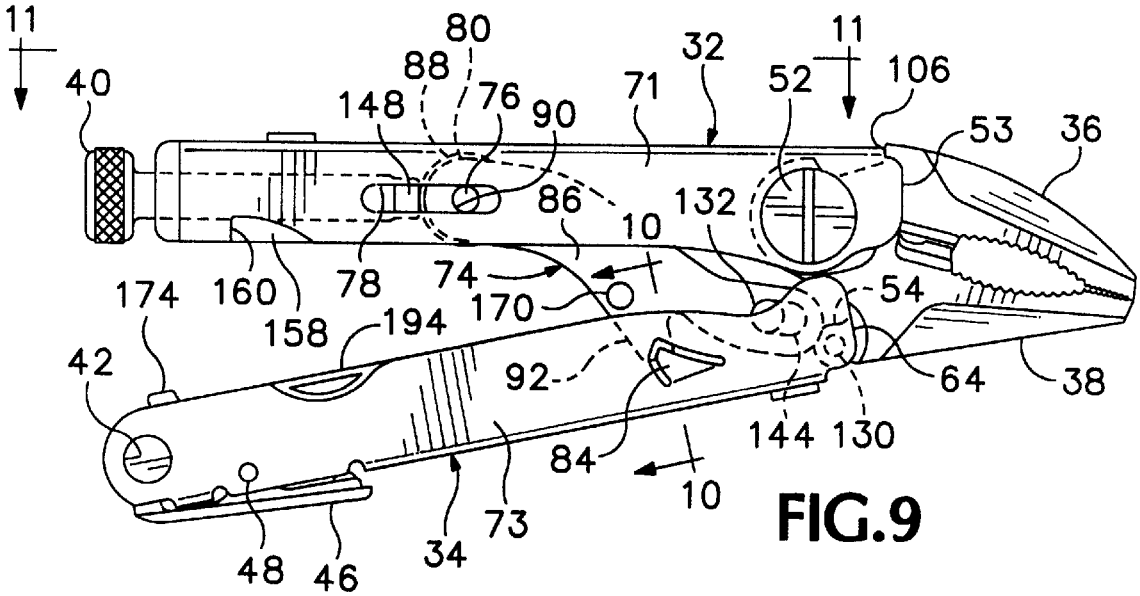
FIG. 9 is a side elevational view of the folding tool, in the operational configuration with the jaws closed as shown in FIG. 1.

A stop arm 92 of each of the struts 86 is aligned with the limit stops 84 when the jaws 36 and 38 are in the extended and operative positions shown in FIG. 9. A shallow V-shaped notch 93 is preferably provided in the end of each stop arm 92 to receive a respective one of the limit stops 84, preventing the lower handle 34 from moving further toward the upper handle 32 beyond the position shown in FIG. 9. As will be explained subsequently, this relationship of the limit stops 84 with the stop arms 92 plays an important part in the manner in which the jaws 36 and 38 may be locked when gripping an object.

A U-shaped portion of the strut 86 beside the stop arm 92 may be beveled to a sharp edge as shown in FIG. 6 to form a wire-stripper 99. A wire to be stripped is supported by an adjacent part of the top edge 68 of the lower handle 34.

Figure 12:
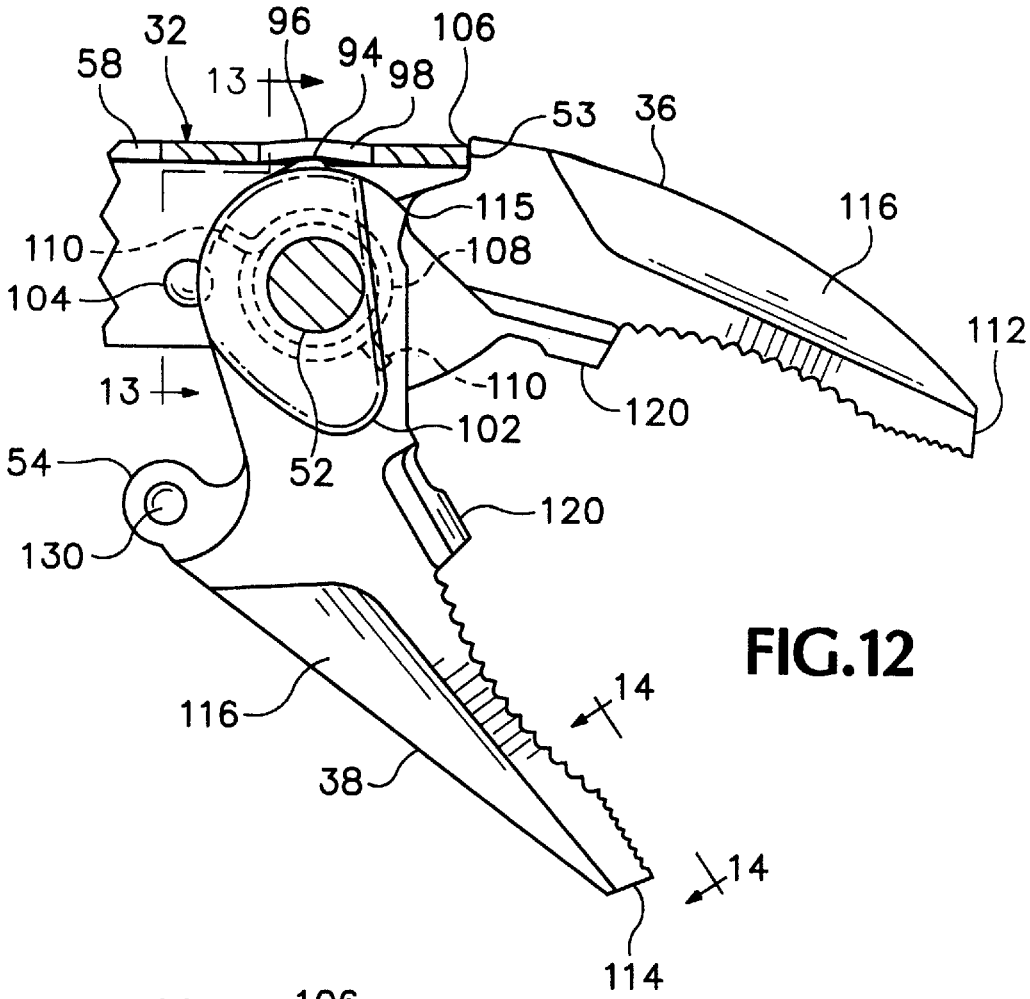
FIG. 12 is a partially cutaway side elevational view of the jaws of the locking pliers, together with a portion of the upper handle of the tool.
Figure 13:
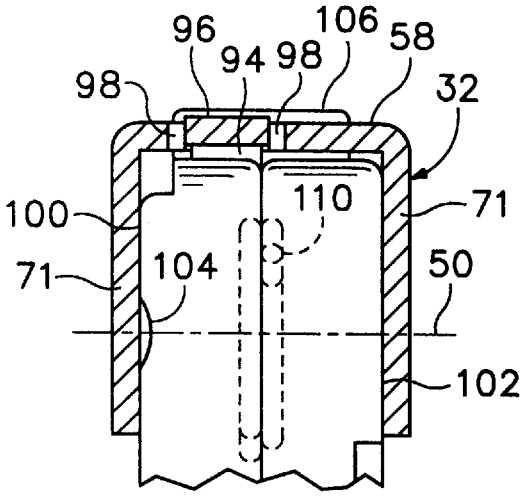
FIG. 13 is a section view of the upper handle and portions of the pliers jaws of the tool, taken along line 13—13 of FIG. 12.

The upper and lower jaws 36 and 38 are both rotatably mounted on the jaw pivot shaft 52, as shown in FIG. 12. When the upper jaw 36 is in its extended position, as shown in FIGS. 12 and 13, it is retained by friction between a small raised cam portion 94 and a retention spring 96 defined by a pair of short parallel slits 98 in the back or outer side 58 of the upper handle 32. See also FIG. 3. As seen in FIG. 13, cheeks 100 and 102 are included in the jaws 36 and 38 and may be additional material cast with and protruding laterally from the bases of jaws 36 and 38, respectively. The cheeks 100 and 102 have mirror-image opposite shapes, and extend laterally outward along the main jaw pivot axis 50 to keep the jaws 36 and 38 centered between the sides 71 of the upper handle 32.

As seen in FIG. 12, an upper portion of the upper jaw 36 has a rearwardly directed face 106 that rests against the back 58 of the upper handle 32 at its front end 53, in an abutment relationship preventing the upper jaw 36 from moving counterclockwise with respect to the upper handle 32. As a result, when the jaws are in the positions shown in FIG. 1 and FIG. 12, the upper jaw 36 is held stationary with respect to the upper handle 32, while the lower jaw 38 is free to rotate about the jaw pivot shaft 52.

A short torsion spring 108 has radially-extending ends 110 each engaged with a notch provided in a respective one of the jaws 36 and 38 so that the torsion spring 108 urges the outer ends 112, 114 of the jaws 36, 38, respectively, apart from each other with sufficient force to overcome friction between the lower jaw 38 and the adjacent surfaces of the upper handle 32 and the upper jaw 36 and the jaw pivot shaft 52. The jaws 36, 38 thus tend to open apart from each other as limited by the shape of the bases of the jaws at 115 in FIG. 12, unless they are squeezed together by action of the handles 32, 34.

Figure 2:
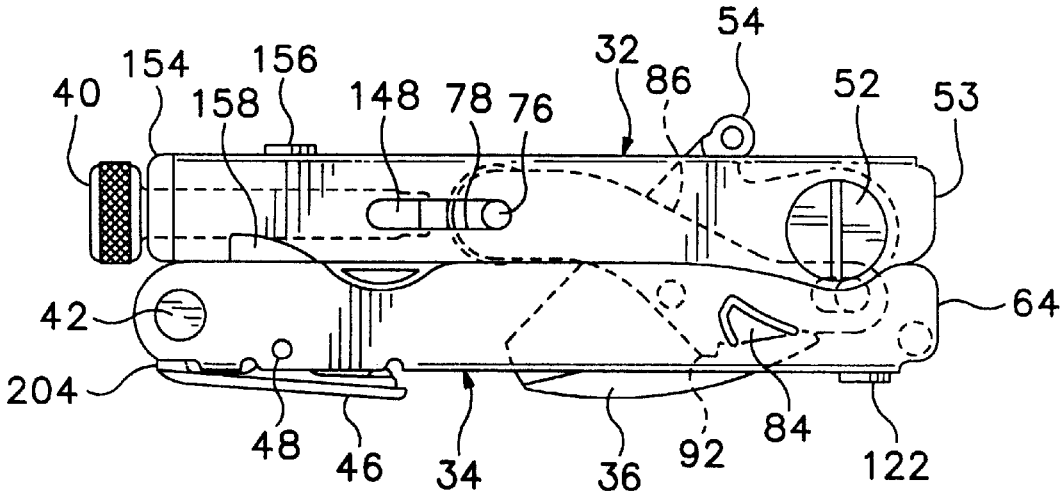
FIG. 2 is a right side elevational view of the folding tool shown in FIG. 1 in a compact fully folded configuration.
Figures 3, 4, 5:
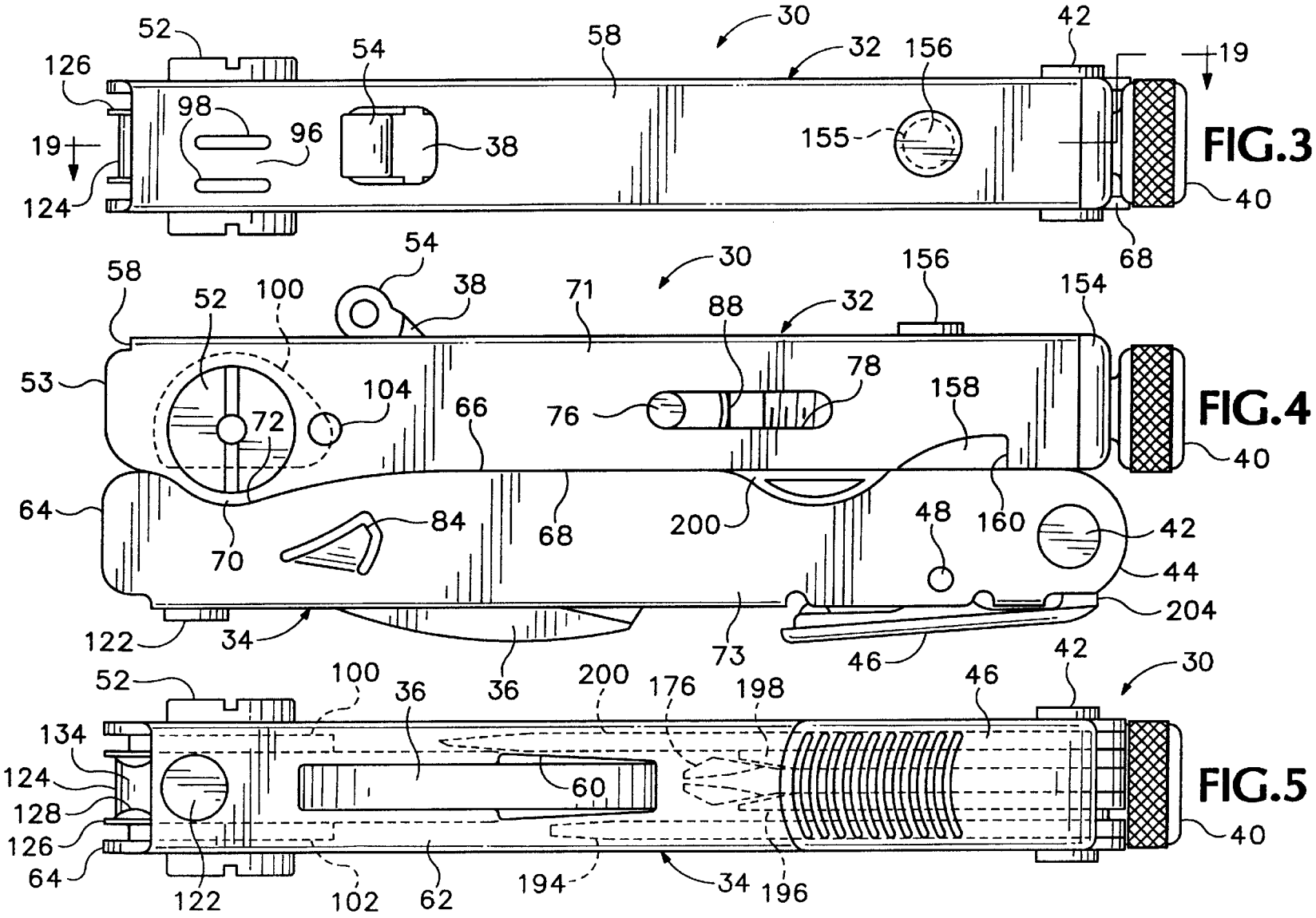
FIG. 3 is a top plan view of the tool shown in FIGS. 1 and 2, in the fully folded configuration shown in FIG. 2.
FIG. 4 is a left side elevational view of the folding tool in the fully folded configuration shown in FIG. 2.
FIG. 5 is a bottom plan view of the folding tool in the fully folded configuration.

As the jaws 36 and 38 are rotated about the jaw pivot shaft 52 in moving them from the extended, operational positions to the folded positions depicted in FIGS. 2–5, a small inwardly protruding bump 104, preferably formed by coining the left side 71 of the upper handle 32, comes to bear against the cheek surface 100 on the upper jaw 36 with sufficient force for friction then to retain both of the jaws 36 and 38 in the position shown in FIG. 2, overcoming the opening force of the spring 108.

Figure 14:
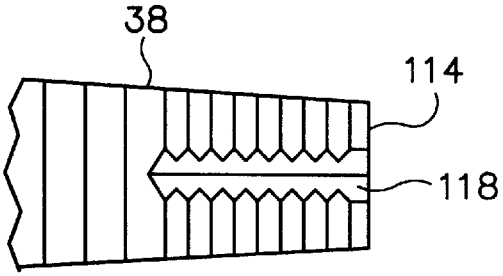
FIG. 14 is a view of a portion of one of the pliers jaws of the tool, taken in the direction of line 14—14 of FIG. 12.

As seen in FIG. 12, the gripping surface of the upper jaw 36 is angled slightly downward with respect to the upper handle 32, providing a comfortable angle for holding the tool 30 while gripping an object between the jaws 36 and 38. The jaws 36 and 38 each include a spine portion 116 slightly narrower than the working faces of the jaws 36 and 38. Preferably, a narrow V-shaped groove 118 (see FIG. 14) is provided in the working face of each outer end 112, 114, so that small round objects such as nails can be gripped and pulled; or narrow objects such as the tang of a saber saw blade may be gripped securely and the tool used as a saw.

Each of the jaws 36 and 38 includes a sharpened wire cutter section 120 in a preferred version of the tool 30. In other versions of the tool 30, not shown, different cutting edges could be provided.

Referring next to FIGS. 15–18, the front end 64 of the lower handle or operating lever 34 is attached, preferably by a fastener such as a screw 122, to a thrust block 124 that is part of a jaw-moving linkage including the strut assembly 74. The thrust block 124 is of metal and may preferably be made by metal injection molding, but could also be made in other ways.

Figures 15, 15A:
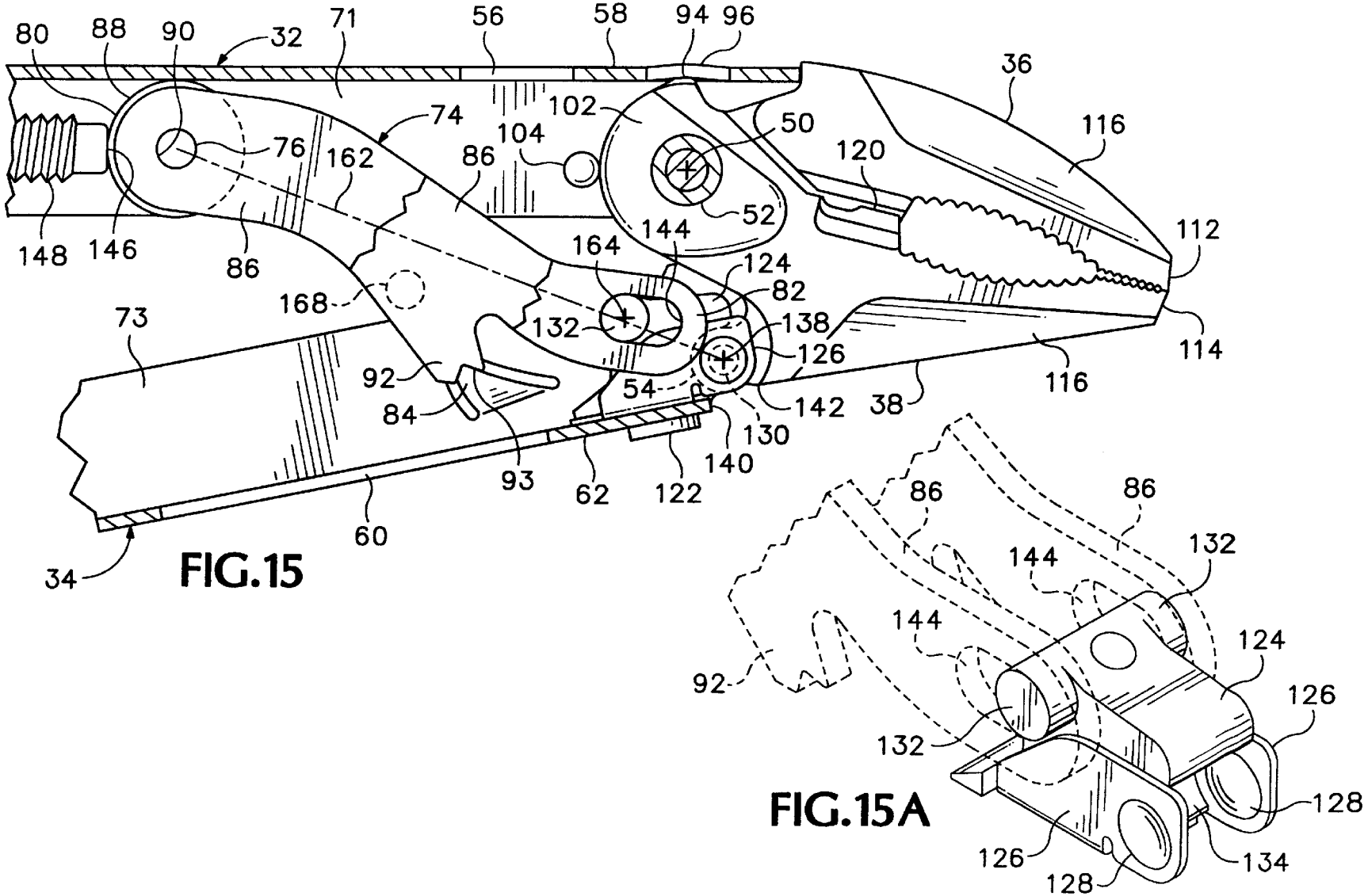
FIG. 15 is a view of a portion of the tool, taken in the same direction as FIG. 9, but with portions of the handles cut away to disclose the operational relationships among elements of the tool located within the handles.
FIG. 15A is an isometric view of a thrust block and detent spring, from the upper right front of the tool, showing a part of the strut assembly in phantom line.
Figure 16:
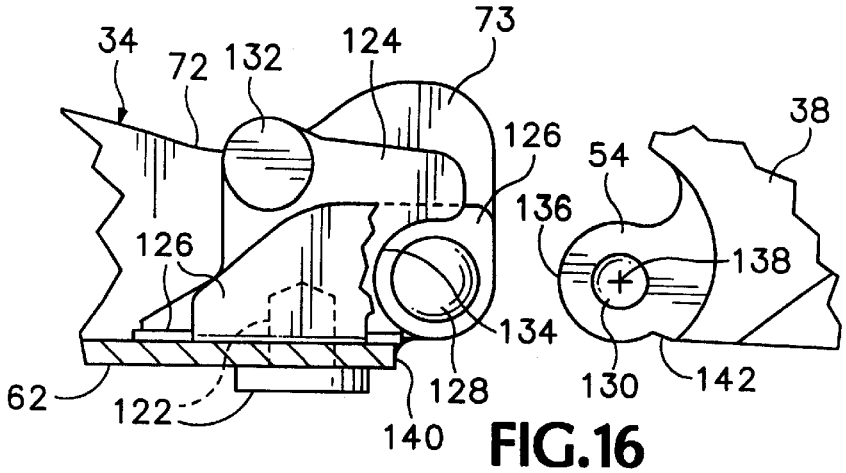
FIG. 16 is a detail view taken in the same direction as FIG. 15, at an enlarged scale, showing a thrust block and a portion of the lower handle, together with a heel portion of the lower jaw.
Figure 17:
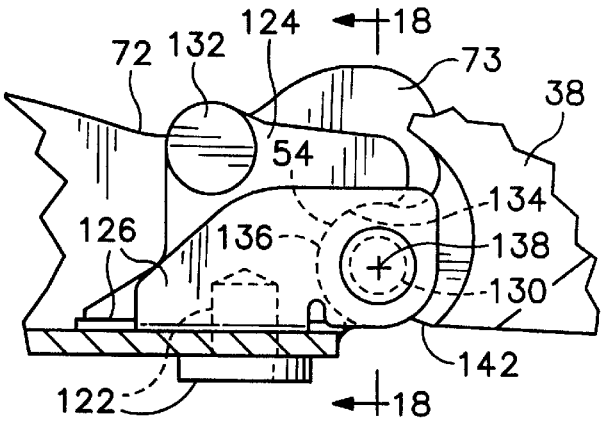
FIG. 17 is a view similar to FIG. 16, but showing the thrust block detachably connected to the heel of the lower jaw.
Figure 18:
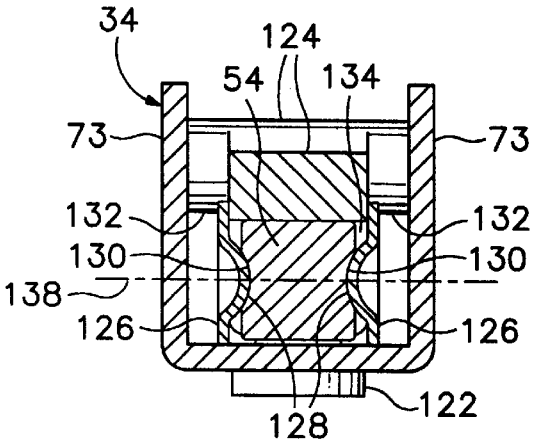
FIG. 18 is a section view taken along line 18—18 of FIG. 17.

A central portion of a detent spring 126 of thin spring material is sandwiched between the thrust block 124 and the inner surface of the back 62 of the lower handle 34, and a pair of parallel side portions of the detent spring 126 extend therefrom closely along respective sides of the thrust block 124, as may be seen best in FIGS. 11, 15A and 18. The side portions of the detent spring 126 are formed to provide a pair of detent protrusions 128 facing inwardly toward each other and aligned with each other to resiliently grip the heel portion 54 of the lower jaw 38 and fit into detent dimples 130 to interconnect the front end 64 of the lower handle 34 with the heel 54 in an easily releasable manner.

Located on the thrust block 124 are a pair of coaxial pivot arms 132, one on each side of the thrust block 124, extending laterally to the inner face of the adjacent side 73 of the lower handle 34, as shown best in FIG. 18, to interconnect the thrust block 124 with the strut assembly 74 as a jaw control link in the jaw-moving linkage.

The thrust block 124 includes a concave forward surface 134, and the heel 54 includes a convex rear surface 136. The two surfaces 134 and 136 are preferably both cylindrical and of nearly the same radius of curvature so that they fit slidingly and concentrically together to permit the thrust block 124 to rotate with respect to the heel 54 about an axis of rotation 138 extending transversely of the tool 30.

When the lower handle 34 is engaged with the heel 54, the detent spring 126 retains the heel 54 adjacent the thrust block 124 with the surfaces 134 and 136 in mated relationship with one another for relative rotation about the axis 138. The detent protrusions 128 are preferably located with their centers slightly closer than the axis 138 to the concave surface 134 of the thrust block 124, so that cam action of the surfaces of the dimples 130 on the detent protrusions 128 will keep the surfaces 134 and 136 snugly together during use of the locking pliers.

The detent spring 126 can be flexed by cam action of the dimples 130 to disengage the detent protrusions 128 from the dimples 130 by simply rotating the lower handle 34 counterclockwise from the position shown in FIG. 9 past the position shown in FIG. 8A. The front margin 140 of the back 62 will ride upon the heel 54 where it joins the lower jaw 38 at 142, using it as a fulcrum so that further rotation then forces the detent protrusions 128 to be disengaged from the dimples 130, allowing the lower handle 34 to separate from the heel 54.

Jaw Adjustment and Locking

The strut assembly 74 is connected with the thrust block 124 as a part of the jaw-moving linkage by engagement of each of the pivot arms 132 in a respective elongated hole 144 in each of the struts 86, at the front end 82 of the strut assembly 74. In one method of assembly, the pin 76 is inserted from outside the upper handle 32 through one of the slots 78 into the bores 90 in the struts 86 and through the strut block 88 after the struts 86 have first been placed on opposite sides of the thrust block 124 with the pivot arms 132 engaged in the elongated holes 144.

In an alternative construction (not shown) the strut block 88 could be attached to the struts 86 by a separate fastening, and the pin 76 could be fitted removably or even be made as a spring-loaded pin to permit complete separation of the handles 32, 34 from each other.

The rear end 80 of the strut assembly 74 is moveable longitudinally along the upper handle 32 of the folding multipurpose tool 30 within the slots 78 in which the opposite ends of the pin 76 are engaged. Movement of the rear end 80 is limited further by the location of the forward end 146 of the adjustment screw 148, which limits rearward movement of the strut block 88.

Figure 19:
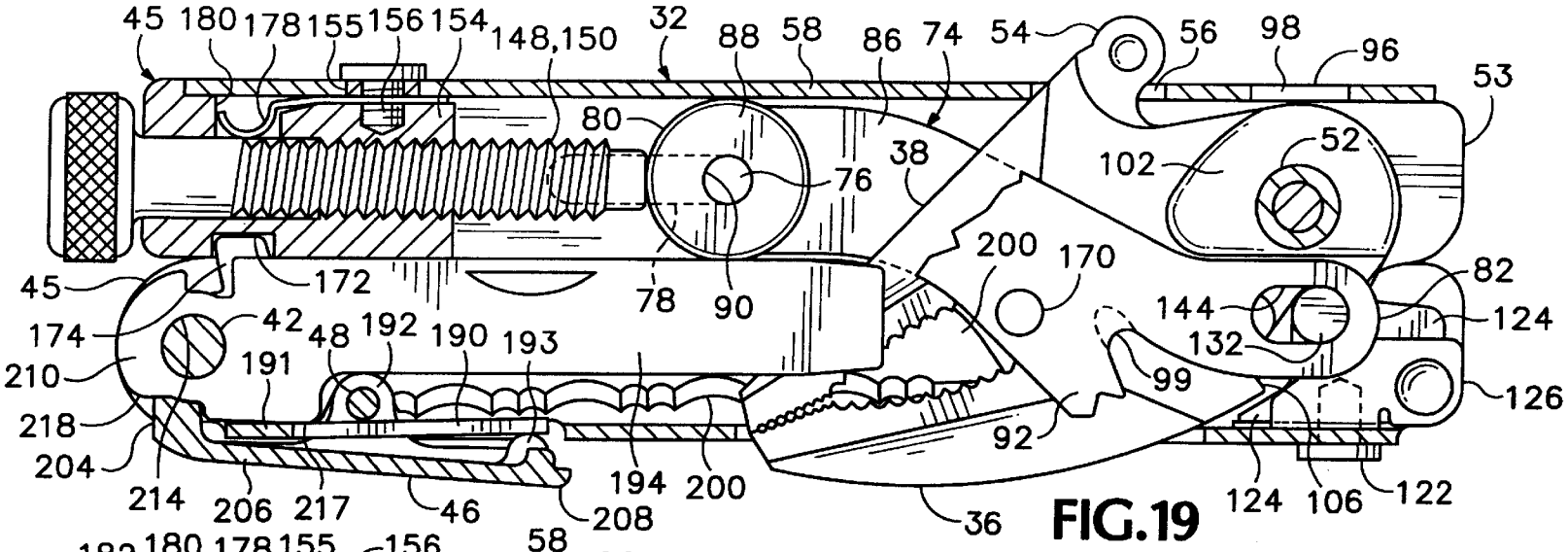
FIG. 19 is a section view from the right side of the tool, taken on line 19—19 of FIG. 3.

As shown in FIG. 19, the threads of the adjustment screw 148 are in mated engagement with a threaded bore 152 in an adjustment block 154 mounted in the rear end of the upper handle 32. The adjustment block 154 may be manufactured by metal injection molding techniques and is retained in the handle 32 by a fastener such as an attachment screw 156 fitted into a boss 155 that protrudes from the block 154 and extends through a corresponding hole in the back 58. Axial forces are carried from the adjustment block 154 to the upper handle 32 by the boss 155, the screw 156, and a pair of ears 158 formed as part of the adjustment block 154 and resting against corresponding vertical surfaces 160 of a cutout provided in each of the sides 71 of the upper handle 32.

The jaw control linkage, then, controls the position of the lower jaw 38 with respect to the upper jaw 36 when the upper jaw 36 is in its extended position and the lower jaw 38 is in its operative position with the front end 64 of the lower handle 34 connected with the heel 54 of the lower jaw 38 by the heel 54 being mated with the thrust block 124. Movement of the lower handle 34, to which the thrust block 124 is connected, moves the pivot arms 132 with respect to an imaginary force line 162 extending from near the axis of rotation 138 to a location near the central axis of the pin 76. The exact places of application of the forces in the jaw-moving linkage, it will be understood, are determined principally by the contact between the surface 134 of the thrust block 124 and the surface 136 of the heel 54, and by the resolution of forces among the end 146 of the adjustment screw 148, the outer surface of the strut block 88, and inside surfaces of the handle 32. With the pivot arms 132 riding in the ends of the elongated holes 144 nearer to the rear end 80 of the strut assembly 74, as the central axis 164 of the pivot arms 132 approaches the imaginary line 162, the heel 54 is urged away from the pin 76 by the thrust block 124, and thus the lower jaw 38 is urged to pivot about the jaw pivot shaft 52 toward the upper jaw 36.

When the handles 32 and 34 are separated and the jaws 36 and 38 are opened apart from each other the central axis 164 is on the side of the imaginary line 162 closer to the lower handle 34. With the central axis 164 of the pivot arms 132 located on the imaginary line 162, the distance between the upper and lower jaws 36 and 38 is at the minimum established by the particular position of the forward end 146 of the adjustment screw 148. As the lower handle 34 is rotated further toward the upper handle 32 about the axis of rotation 138 the central axis 164 moves over-center across the imaginary line 162 a small distance. At that point the stop arms 92 come into contact with the limit stops 84, as shown in FIGS. 9, 10 and 15, with only a small relaxation of pressure between the jaws 36 and 38 and an object held between them. Thus, the tool 30 provides over-center locking pliers with jaws that can be folded to a compact configuration. Forces urging the jaws 36 and 38 apart from each other are carried through the jaw control linkage and urge the stop arms 92 toward the limit stops 84, thus keeping the jaws 36 and 38 locked in such an over-center relationship. To release the grip of the jaws 36 and 38 it is merely necessary to move the handles 32 and 34 apart from each other far enough to move the central axis 164 back over-center toward the lower handle 34.

Movement of the adjustment screw 148 rearward by rotation of the adjustment knob 40 provides for greater spacing between the outer ends 112 and 114 of the jaws 36 and 38. The adjustment screw also acts as an extension of the upper handle 32 to give greater leverage to be applied to the upper handle 32 as the jaws 36 and 38 are separated further.

It will be understood that the forces urging the lower jaw 38 toward the upper jaw 36 are compressive forces carried from the rear end 45 of the upper handle 32 through the adjustment block 154 and adjustment screw 148, and through the strut assembly 74 from the forward end 146 of the adjustment screw 148, through the strut block 88, the pin 76, the struts 86, and the rear ends of the elongated holes 144 and the pivot arms 132 into the thrust block 124, and that these forces are then carried by the thrust block 124 into the heel 54 of the lower jaw 38 through the mutually contacting surfaces 134 and 136. Because of the geometry between the thrust block 124 and the remainder of the jaw-moving linkage, the attachment of the lower handle 34 to the thrust block 124 need never be subjected to an extremely large amount of force, and the screw 122 therefore need not be large.

As shown in FIG. 19, when the tool 30 is in the compact folded configuration the pivot arms 132 are located in the front end of the elongated holes 144. As may be seen in FIG. 2, this allows the stop arms 92 to slide into the space defined within the channel between the sides 73 of the lower handle 34, without engaging the limit stops 84, and the limit stops 84 fit in the U-shaped area of the struts 86 beside the stop arms 92. Referring again to FIG. 19, with the pivot arms 132 in the front ends of the elongated holes 144, and with the strut assembly 74 moved toward the front end 53 of the upper handle 32 so that the pin 76 moves toward the forward end of the slots 78, the ends of the upper handle 32 can be aligned with the ends of the lower handle 34, with the thrust block 124 fitting adjacent the rear face 106 of the upper jaw 36. The jaws 36 and 38 are located between the struts 86, which extend closely along the cheeks 100 and 102 at the front end 82 of the strut assembly 74.

Once the jaws 36 and 38 are placed as shown in FIG. 6, the just-described alignments occur without any particular effort as the handles 32 and 34 are moved to the configuration shown in FIG. 2. Although parts of the design and construction are complex, most of the motions and positioning of the various components which are required when using the tool occur automatically or intuitively to the user.

A bump 168, shown in FIG. 11, protrudes outwardly from one of the struts 86 toward the inner surface of the adjacent side 73 of the lower handle 34, pressing against it with sufficient friction to keep the strut 86 in the folded position within the lower handle 34, thereby retaining the upper and lower handles 32 and 34 together when the tool 30 is in the compact folded configuration. The bump 168 may be created by coining the left strut 86. A hole 170 may be provided in the right strut 86 to assist in forming short radius bends in wires, and to provide access after assembly of the tool 30, to make adjustments to the bump 168.

Figure 21:
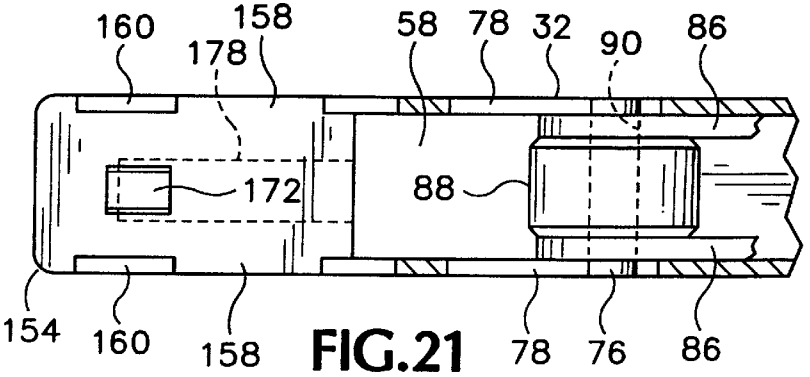
FIG. 21 is a view of the tool taken along line 21—21 of FIG. 20, showing the adjustment block for the locking pliers, and showing the interconnection of the strut assembly with the upper handle.
Figure 20:
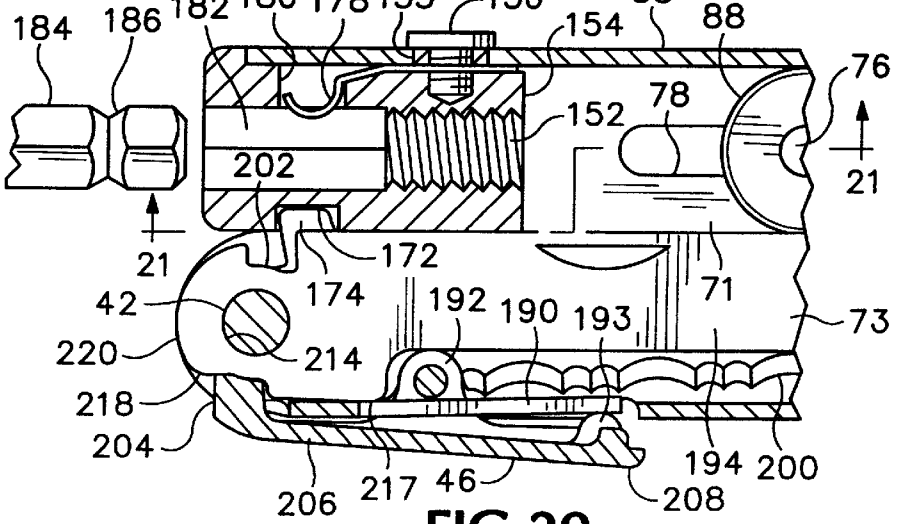
FIG. 20 is a view similar to a portion of FIG. 19, showing a tool bit aligned with the tool bit drive socket portion of the upper handle of the tool.

As may be seen in FIGS. 19–21, the adjustment block 154 defines a rectangular stabilizer cavity 172 facing openly toward the interior of the channel defined by the lower handle 34. A projecting part 174 located in the lower handle 34 extends into the cavity 172, stabilizing the lower handle 34 both laterally and longitudinally with respect to the adjacent upper handle 32 when the tool 30 is in its compact folded configuration. It will be understood that the stabilizer cavity 172 need not have any specific shape, but that the cavity 172 and the projecting part 114 preferably should correspond generally in size and shape.

The projecting part 174 may be, for example, a portion of the base or tang 210 of one of the folding tool blades carried on the blade pivot shaft 42, and preferably is part of the tang 210 of the Phillips head screw driver 176, as may be seen in FIG. 1. Because of its shape the Phillips head screwdriver 176 may be made by metal injection molding, although other methods of manufacture may also be used.

Referring still to FIG. 19, it will also be seen that a retention spring 178 is mounted within the upper handle 32, with its base portion located between the adjustment block 154 and the inner surface of the back 58, where the retention spring 178 is held in place by the attachment screw 156. An outer end of the retention spring 178 extends inwardly through an opening 180 defined in the adjustment block 154, and presses against the surface of the adjustment screw 148, to prevent the adjustment screw 148 from being moved unintentionally and thus inadvertently being removed from its threaded bore 152 when the folded tool 30 is not being used, and to prevent changing an adjustment of the jaws when none is intended, during use of the tool 30.

The portion of the adjustment block 154 nearest the rear end 45 of the upper handle 32 defines a tool bit driving socket, for example a hexagonal socket 182 preferably, but not necessarily, at least slightly larger in its minimum dimensions than the outer diameter of the threads 150 of the adjustment screw 148, although threads 150 could also be formed to some extent in the walls of the tool bit driving socket. The tool bit driving socket is of an appropriate size to receive a shank of a tool bit such as the hexagonal shank 184 shown aligned with the open end of the socket 182 in FIG. 20. The outer end of the retention spring 178 thus extends in through a wall of the socket 182 to press against a tool bit shank located in the socket 182. The spring 178 is preferably located in such a position with respect to the length of the socket 182 that its outer end can extend slightly into a detent groove 186 defined in the shank 184 to hold the tool shank 184 in the socket 182.

It will be appreciated that engagement of the projecting part 174 in the hole 172 is useful in keeping the upper and lower handles 32 and 34 aligned with each other when the tool 30 is used to rotate a tool bit whose shank 184 is engaged in the socket 182.

Latch Mechanism for Folding Tool Blades

Figure 22:
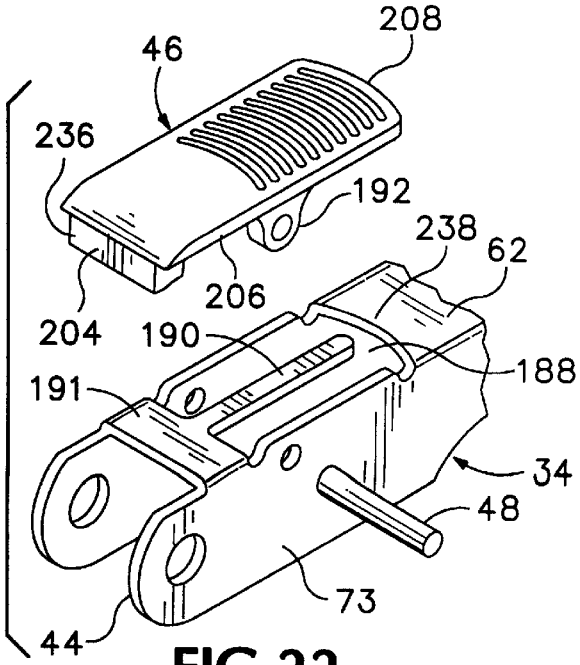
FIG. 22 is a perspective exploded view of a portion of the lower handle of the tool and the blade latch lever.
Figure 23:
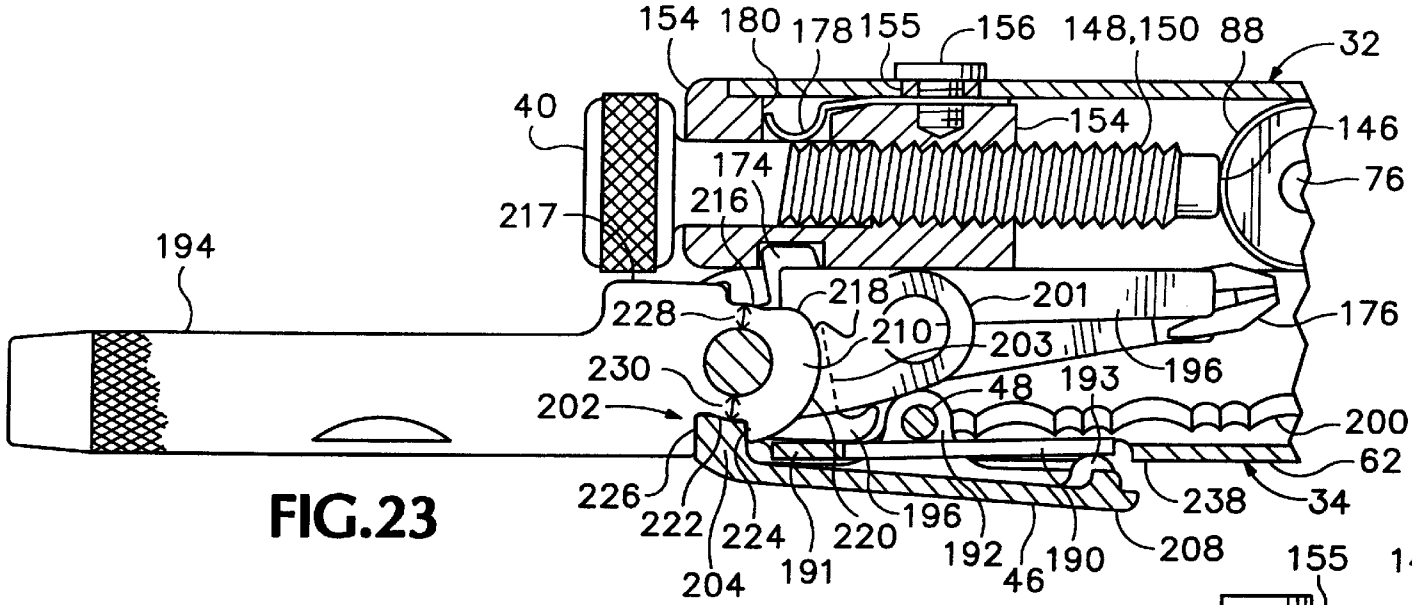
FIG. 23 is a section view taken in the same direction as FIG. 19, showing portions of the handles, with a folding tool blade latched in an extended position.
Figure 24:
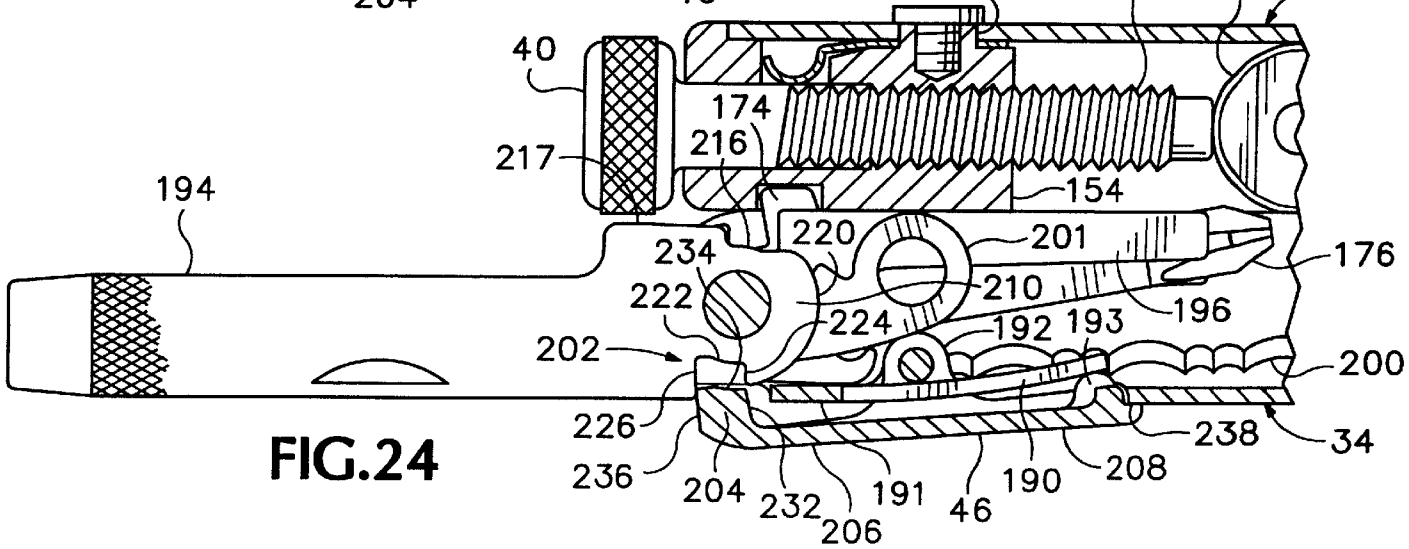
FIG. 24 is a view similar to FIG. 23, showing the blade latch lever moved to a position releasing the tool blade to be moved toward a folded position.

Referring to FIGS. 22–24, the previously mentioned latch mechanism will be explained in greater detail. In FIG. 22, it will be seen that an aperture 188 is defined by the outer side or back 62 of the lower handle 34 adjacent its rear end 44, and a long narrow spring 190 remains as a portion of the back 62, extending axially with respect to the lower handle 34 into the open area of the aperture 188 from a remaining transverse band 191 of the material of the back 62. The latch lever 46 has a pair of ears 192 located closely alongside the inner surfaces of the sides 73 of the lower handle 34, and thus in positions straddling the spring 190. The ears 192 define collinear bores to receive the pivot pin 48, which extends transversely of the lower handle 34 through the collinear bores in the sides 73 and through the bores in the ears 192. As may be seen in FIG. 23, a protrusion 193 is provided on the rear end of the latch lever 46, where the protrusion 193 rides against the free end of the spring 190, deflecting it slightly inward with respect to the lower handle 34 when a tool blade, such as the combined file and screwdriver blade 194, has been pivoted about the blade shaft 42 to an extended position.

In addition to the file blade 194 with its straight screwdriver tip, there may be additional tool blades, such as a narrow straight bladed screwdriver 196 combined with a bottle cap remover, a medium width screwdriver 198, and a knife blade 200, as well as the previously mentioned Phillips head screwdriver 176.

So that adjacent blades do not move with each other, these tool blades are preferably separated from one another along the blade pivot shaft 42 by thin spacers (not shown) that rest on the interior of the handle 34 and thus cannot rotate about the shaft 42. Between the file blade 194 and the combined small screwdriver and bottle cap remover 196, a lanyard eyelet 201 of thin sheet metal is provided. It will be appreciated that the lanyard eyelet 201 need not be in that location, but the screwdriver 196, because of its small size, may be of reduced thickness to provide space conveniently for the lanyard eyelet 201 alongside the small screwdriver 196. The lanyard eyelet 201 is preferably of a shape which is symmetrical about an imaginary line 203 shown in FIG. 23, in order to simplify assembly of the tool 30, and can be rotated into the handle if not being used.

The small screwdriver 196 and medium screwdriver 198 are preferably flat on their sides facing apart from each other, while the opposite faces, adjacent the centrally-located Phillips head screwdriver 176, are tapered to the desired thickness of the edge of each of the screwdrivers 196 and 198, leaving room for the cruciform tip of the Phillips head screwdriver 176 between them.

Each of the folding tool blades 176, 194, 196, 198, and 200 has a tang or base portion 210 defining a respective bore 214 through which the blade pivot shaft 42 passes with a close fit permitting each of the tool blades to rotate smoothly about the blade pivot shaft 42. The base or tang 210 of each of the tool blades also includes a respective notch 202 to receive the catch body 204 located at one end of a catch carrier arm 206 portion of the latch lever 46. On the opposite side of a pivot axis defined by the ears 192 and pivot pin 48 is a rear end or latch release push button portion 208 of the latch lever 46, whose outer side preferably is provided with a non-slip surface such as the parallel grooves illustrated in FIG. 22.

Approximately opposite the notch 202 on the tang or base 210 of each of the tool blades 176, 194, 196, 198 and 200, separated from the notch 202 by an angle of about 160–180°, is an arcuate surface 216, adjacent which is a cam lobe 218. Between the cam lobe 218 and the notch 202 is a substantially arcuate margin surface 220 of a radius greater than that of the arcuate surface 216 preferably centered on the shaft 42. A projecting face or kick 217 on each tool blade is provided to prevent each tool blade from moving too deeply into the channel of the lower handle 34.

Within the notch 202 is an arcuate bottom surface 222, adjoining an anti-folding face 224 extending inwardly from the surface 220 to define one side of the notch 202. Opposite the anti-folding face 224, and thus defining the opposite side of the notch 202, is an abutment surface 226. A radial dimension 228, between the blade pivot shaft 42 and the arcuate surface 216, and a radial dimension 230, between the blade pivot shaft 42 and the arcuate bottom surface 222 of the notch 202, are preferably equal to each other and at least as great as a minimum required for the tang 210 to be of ample strength. The arcuate surfaces 216 and 222 are preferably circular and concentric with the tool pivot shaft 42 to provide the greatest radial dimensions 228 and 230 for practicality, but other slightly different curvatures or locations of those surfaces could also be used in accordance with this invention.

As seen in FIG. 24, the catch body 204 includes a rear face 232, a bottom face including an arcuate surface 234, and a front face 236, which correspond respectively with the anti-folding surface 224, the arcuate bottom surface 222, and the abutment surface 226 of the notch 202.

The push button end 208 of the latch lever 46 overhangs the back 62 of the handle 34 beyond the aperture 188, as shown in FIGS. 23 and 24, so that the margin 238 of the aperture 188 performs as a positive stop to limit the range of motion of the push button or latch release portion 208 of the latch lever 46, as shown in FIG. 24. Ordinarily, the spring 190, resting against the protrusion 193, urges the latch lever 46 to rotate toward the position shown in FIG. 23, in which the catch body 204 is mated fully within the notch 202 of any of the tool blades which is in its extended position, ready for use.

When the rear or push button portion 208 of the catch lever 46 is depressed fully to the position shown in FIG. 24, the rear face 232 is disengaged from the anti-folding face 224 of the notch 202, freeing an extended tool blade such as the file and screwdriver 194 to move, clockwise as shown in FIG. 24, toward a folded position for storage within the handle 34. Nevertheless, a part of the front face 236, because of its greater length in a generally radial direction, remains opposite the abutment surface 226 within the notch 202, preventing an extended tool blade from moving too far around the blade pivot shaft 42 in the direction away from the stowed, folded position in the lower handle 34. Thus, regardless of the push button end 208 of the latch lever 46 having been depressed, a selected blade will not collapse in the direction of opening the blade beyond its normal extended position.

When the upper handle 32 is separated from the lower handle 34, if the push button end 208 of the latch lever 46 is depressed to its limited position as shown in FIG. 24, any tool blade which has been extended can then be rotated back into its storage position in the lower handle 34, with the arcuate surface 234 of the catch body 204 riding along the outer arcuate surface 220 of the tang or tangs 210. When the catch body 204 is thus riding along the arcuate surface 220 of one of the blades, others of the blades are also free to move between a folded position within the handle 34 and an extended position. Preferably, a small amount of side pressure is provided to keep the folding tool blades in their folded positions. Additionally, if one of the folding tool blades 176, 194, 196, 198 or 200 is moved outwardly from its folded position within the lower handle 34 the cam 218 will raise the catch body 204 as such a blade is moved outward, releasing a blade that previously was in its extended position to be rotated about the blade pivot shaft 42.

When all of the tool blades 176, 194, 196, 198 and 200 or such blades as are located in the lower handle 34 in place of those specific blades, are folded, the spring 190, acting against the protrusion 193, keeps the folded tool blades in their respective folded positions by urging the catch body 204 against the arcuate surfaces 216, and against the cam 218 of the tang 210 of any blade beginning to rotate away from the folded position.

The presence of the arcuate surface 234, corresponding with the shape of the arcuate surfaces 216 and 222, provides room between the catch body 204 and the blade pivot shaft 42 for ample material for strength of the tangs 210. This shape also leaves room for an anti-folding surface 224 of ample size, and provides for the front face 236 to extend radially further into the handle 34 than the rear face 232, so that the rear face 232 can be disengaged from the anti-folding face 224 without disengaging the front face 236 from the abutment 226 in the limited space available in a compact folding tool.

It will be noted that the Phillips screwdriver 176, in its folded position, is inclined upward toward the margins of the sides 73 of the lower handle 34 so that its outer end is available to be engaged to lift the Phillips screwdriver 176 from its folded position. Accordingly, a notch 202 in the tang 210 of the Phillips screwdriver is aligned at a slightly different angle with respect to the kick 217 in order to have the shank of the Phillips screwdriver 176 aligned properly with the lower handle 34 in its extended position.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A folding hand tool, comprising:

(a) a first body member having a front end and an inner side;

(b) a main jaw pivot located at said front end of said first body member;

(c) a first jaw attached to said first body member by said main jaw pivot and moveable about said main jaw pivot from an extended position, toward said inner side of said first body member to a folded position adjacent said inner side of said first body member;

(d) a second jaw moveable pivotally with respect to said first jaw and moveable relative to said first body member from an operative position to a folded position adjacent said inner side of said first body member; and (e) a jaw-moving linkage extending between said first body member and said second jaw, said jaw-moving linkage including a jaw control link that is detachably interconnected with and acting on said second jaw when said second jaw is in said operative position and that is disconnected from said second jaw when said second jaw is in said folded position, so as to enable said second jaw to move toward said folded position by moving toward said jaw control link.

2. The folding hand tool of claim 1, wherein said jaw-moving linkage includes a pair of struts spaced apart from each other laterally of said hand tool, said jaws being located between said struts of said pair when said jaws are in their respective folded positions.

3. The folding hand tool of claim 1, wherein said first body member includes a back side and an abutment in said back side thereof, a portion of said first jaw resting against said abutment in said extended position of said first jaw.

4. The folding hand tool of claim 1, including an operating lever attached to said jaw control link.

5. The folding hand tool of claim 1, wherein said jaw-moving linkage is movable through a jaw-moving range of positions and into an over-center jaw-locking position, when said jaws are respectively in said extended and operative positions thereof.

6. The folding hand tool of claim 5, including a handle defining a cavity facing openly toward said first body member, wherein said jaw-moving linkage includes a strut having a stop arm, said handle including a limit stop located in said cavity, and said limit stop obstructing said stop arm and thereby establishing said over-center jaw-locking position.

7. The folding hand tool of claim 6 wherein said handle includes a channel having a pair of sides and said limit stop is an inwardly projecting portion of one of said sides.

8. The folding hand tool of claim 6 wherein said strut is part of a strut assembly having a front end interconnected with said jaw control link so that said jaw control link is movable longitudinally along said strut assembly from a first position occupied when said jaws are in said extended and operative positions to a second position in which said stop arm bypasses said limit stop and said strut assembly can be moved into said cavity of said handle farther than when said jaw-moving linkage is in said over-center jaw-locking position.

9. The folding hand tool of claim 5, wherein said first body member and said operating lever are handles thereof and are spaced apart from each other when said jaw-moving linkage is in said over-center jaw-locking position.

10. The folding hand tool of claim 5 including an adjustment mechanism located in said first body member and acting on said jaw-moving linkage to move a portion of said jaw-moving linkage with respect to said first body member, thereby providing an adjustable jaw spacing between said jaws when said jaw-moving linkage is in said jaw-locking position thereof.

11. The folding hand tool of claim 1 having a compact folded configuration, wherein said first and second jaws are respectively in said folded positions thereof and wherein said first body member is a first handle, and including a second handle attached to said jaw-control link, said handles being located parallel with and closely alongside each other.

12. The folding hand tool of claim 11 wherein said jaw-moving linkage includes a strut assembly having a front end interconnected with said jaw-control link, said jaw-control link being movable longitudinally along said strut assembly from a first position occupied when said jaws are in said extended and operative positions to a second position occupied when folding hand tool is in said compact folded configuration.

13. The folding hand tool of claim 11 wherein said first handle includes a rear end and has a block located at said rear end, said block defining a stabilizer cavity facing openly toward said second handle, and said second handle having associated therewith a projecting part extending within said stabilizer cavity when said folding hand tool is in said compact folded configuration.

14. The folding hand tool of claim 1, wherein at least one of said jaws includes a sharpened cutting edge.

15. The folding hand tool of claim 1, said first body member including a back side and a spring defined by a pair of openings in said back side, said first jaw including a protruding member engaging said spring when said first jaw is in said extended position.

16. The folding hand tool of claim 1, said first body member including a channel having a pair of sides, one of said sides including an inwardly protruding bump engaging said first jaw when said first jaw is in said folded position and resisting movement of said first jaw away from said folded position.

17. The folding hand tool of claim 1, including a spring engaging said first and second jaws and urging them to pivot apart from each other.

18. A manually operated gripping tool comprising:

(a) a first jaw mounted on a first support member;

(b) a second jaw movable about a jaw pivot axis with respect to said first jaw during operation of said hand tool, said second jaw having a heel spaced apart from said jaw pivot axis;

(c) a jaw-moving linkage extending between said first support member and said heel of said second jaw, said linkage including a jaw control link acting on said heel of said second jaw;

(d) a movable jaw control handle having a front end attached to said jaw control link;

(e) a thrust body included in said jaw control link; and (f) a releasable joint interconnecting said thrust body with said heel of said second jaw, said joint including a convex first part and a concave second part located in contact with each other, said thrust body pressing against said heel through said joint and urging said second jaw to rotate about said jaw pivot axis in a jaw-closing direction during use of said tool.

19. The tool of claim 18 wherein said first support member is a first handle.

20. The tool of claim 18 wherein said convex first part is included in said heel and said concave second part is included in said thrust body.

21. The tool of claim 20 wherein said heel includes a side having a detent dimple and wherein said joint includes a detent protrusion and a spring urging said detent protrusion into said dimple when said thrust body is interconnected with said heel by said joint.

22. The tool of claim 20 wherein said convex first part and said concave second part include mating generally cylindrical surfaces having a cylinder axis parallel with said jaw pivot axis.

23. The tool of claim 18, wherein said detachable joint includes a spring-operated detent releasably attaching said thrust body to said heel.

24. The tool of claim 18 wherein said jaw-moving linkage includes a strut assembly extending between said first support member and said thrust body and urging said thrust body toward said heel of said second jaw.

25. A folding hand tool, comprising:

(a) a first handle;

(b) a first jaw interconnected with and movable with respect to said first handle between an extended position and a folded position;

(c) a second jaw interconnected with and movable with respect to said first handle between an operative position and a folded position;

(d) a second handle having a front end detachably interconnected with said second jaw and having an opposite rear end spaced apart from said second jaw; and (e) a strut assembly including a front end pivotally interconnected with said second handle between said front end thereof and said rear end thereof, said strut assembly having a rear end interconnected with said first handle.

26. The folding tool of claim 25, said strut assembly including a pair of struts spaced apart from each other laterally and said jaws extending between said struts when said jaws are in their respective folded positions.

27. The folding tool of claim 25, wherein said strut assembly includes a strut block located at said rear end of said strut assembly between said struts of said pair, separating said struts laterally apart from each other.

28. The folding tool of claim 25 wherein said rear end of said strut assembly is movable longitudinally with respect to said first handle, thereby providing an adjustable range of motion of said second jaw with respect to said first jaw.

29. The folding tool of claim 28, including an adjustment screw carried in said first handle adjustably supporting said rear end of said strut assembly.

30. The folding tool of claim 28 wherein said first handle includes a slot extending longitudinally thereof and wherein said strut assembly includes a transverse pin engaged in said slot.

31. The folding tool of claim 30 wherein said transverse pin is selectively disengageable from said slot.

32. The folding tool of claim 25 wherein said strut assembly includes a strut having a sharpened U-shaped wire-stripper portion.

* * * * *